US010751559B2

(12) United States Patent
Constanza

(10) Patent No.: US 10,751,559 B2
(45) Date of Patent: Aug. 25, 2020

(54) FITNESS TRAINING SYSTEM AND METHOD

(71) Applicant: Elio Constanza, Miami, FL (US)

(72) Inventor: Elio Constanza, Miami, FL (US)

(73) Assignee: Elio Constanza, Homestead, FL (US)

( * ) Notice: Subject to any disclaimer, the term of this patent is extended or adjusted under 35 U.S.C. 154(b) by 2 days.

(21) Appl. No.: 16/282,255

(22) Filed: Feb. 21, 2019

(65) Prior Publication Data

US 2019/0255374 A1 Aug. 22, 2019

Related U.S. Application Data

(60) Provisional application No. 62/633,665, filed on Feb. 22, 2018.

(51) Int. Cl.

| | |
|---|---|
| ***A63B 5/20*** | (2006.01) |
| ***A63B 24/00*** | (2006.01) |
| ***G08B 21/18*** | (2006.01) |

(52) U.S. Cl.

CPC ..... *A63B 5/20* (2013.01); *A63B 24/0062* (2013.01); *A63B 24/0087* (2013.01); *G08B 21/182* (2013.01); *A63B 2230/065* (2013.01)

(58) Field of Classification Search

CPC ..... A63B 24/0087; A63B 24/0062; A63B 2230/065; A63B 5/20–22; A63B 21/0004–00043; A63B 21/02; A63B 2024/0065–0071; A63B 2024/0078–0081; A63B 2230/04–085; G08B 21/182; G08B 6/00; G08B 21/0453

See application file for complete search history.

(56) References Cited

U.S. PATENT DOCUMENTS

| | | | | |
|---|---|---|---|---|
| 6,409,636 | B1 | 6/2002 | Risso et al. | |
| 6,584,344 | B2 | 6/2003 | Hannula | |
| 7,354,383 | B2 | 4/2008 | Bardha | |
| 7,892,145 | B2 | 2/2011 | Lovett et al. | |
| 8,142,333 | B2 * | 3/2012 | LaTour | A63B 5/20 482/8 |
| 8,487,746 | B2 | 7/2013 | Gordon | |
| 9,292,008 | B1 * | 3/2016 | Ahamed | G06F 1/163 |
| 9,655,548 | B2 * | 5/2017 | Hong | A63B 71/06 |
| 9,750,977 | B2 * | 9/2017 | Yuen | G01P 7/00 |
| 9,794,402 | B2 * | 10/2017 | Dvortsov | H04M 3/42365 |
| 10,134,256 | B2 * | 11/2018 | Park | G08B 21/18 |
| 2009/0221401 | A1 * | 9/2009 | Lovett | A63B 1/0622 482/3 |
| 2010/0160116 | A1 * | 6/2010 | LaTour | A63B 5/20 482/8 |
| 2011/0130247 | A1 * | 6/2011 | Lovett | A63B 71/0622 482/3 |
| 2016/0059073 | A1 | 3/2016 | Jeon | |
| 2018/0085653 | A1 * | 3/2018 | Picker | A63B 71/0686 |
| 2019/0053762 | A1 * | 2/2019 | Saigh | G06F 16/436 |
| 2019/0196411 | A1 * | 6/2019 | Yuen | A61B 5/681 |

* cited by examiner

*Primary Examiner* — Andrew S Lo

(57) ABSTRACT

A fitness-training device; the fitness-training device is embedded within a graspable handle of an exercise apparatus and may include a heart rate detector, a repetitive motion counter, and indicators to indicate the heart rate, and repetitive motion count during an exercise activity. The fitness-training device may be incorporated in a wide range of sports and exercise equipment. A version of the fitness-training device arranged as a jump rope is disclosed herein.

19 Claims, 11 Drawing Sheets

FITNESS TRAINING SYSTEM AND METHOD

CROSS REFERENCE TO RELATED APPLICATION

The present application is related to and claims priority to U.S. Provisional Patent Application No. 62/633,665 filed Feb. 22, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of fitness-training devices providing heart rate and activity data during use and more specifically relates to a fitness-training device embedded within a graspable handle of an exercise apparatus, the fitness-training device including a heart rate detector, a repetitive motion counter, and indicators to indicate the heart rate, and repetitive motion count during an exercise activity.

2. Description of Related Art

Some individuals may participate in cardiovascular workouts to achieve a target heart rate range necessary for improving endurance or losing weight. Target heart rates can vary depending on the individual goals of the exerciser, and maintaining a proper target heart rate is essential to meeting those goals. If a user works out in a heart rate range that is too high or too low for the desired goal, results may be disappointing. People using exercise training equipment, such as jump ropes, may have no way to measure and selectively monitor their target heart rates, effort level, and exercise duration, while training. A suitable solution to overcome these limitations would benefit many.

Prior attempts have been made to overcome the above-noted issues. For example, U.S. Pat. No. 7,354,383 to Bardha relates to a jump rope with physiological monitor. The described jump rope with physiological monitor incorporates a sensor in at least one handle which contacts the hand of an exerciser holding the handle. The output signal from the sensor is provided to a microprocessor programmed to analyze the signal and derive a physiological factor of the exerciser such as heart rate and provide a signal of the derived factor to an output device which may be a display or an audio signal generator. Unfortunately, the ability of the device to provide discernable feedback to the user during training is highly limited.

BRIEF SUMMARY OF THE INVENTION

In view of the foregoing disadvantages inherent in the known fitness-training art relating to devices providing heart rate and activity data during use, the present disclosure provides a novel fitness training system and method. The general purpose of the present disclosure, which will be described subsequently in greater detail, is to provide a fitness-training device generating heart rate and activity data during use and more particularly to a fitness training system and method as used to improve the a fitness-training device embedded within a graspable handle of an exercise apparatus, the fitness-training device may include a heart rate detector, a repetitive motion counter, and indicators to indicate the user's heart rate, and repetitive motion count during an exercise activity.

A fitness-training device is disclosed herein. The fitness-training device includes a hand-graspable housing configured to be hand graspable by a user; and an electronic module disposed within the hand-graspable housing, the electronic module may include a heart-beat sensor configured to produce a first set of output signals corresponding to heart beats of the user, a movement sensor configured to produce a second set of output signals corresponding to movement of the user during a fitness activity, a memory configured to store target heart rate range data, a user input element configured to enable the user to input a target heart rate range within the memory, a visual display element configured to display visual information, an illuminated alert element configured to provide an illuminated visual alert discernable by the user, an auditory alert element configured to provide an auditory alert discernable by the user, a haptic alert element configured to provide a haptic alert discernable by the user, a processor communicably coupled to the heart-beat sensor, the movement sensor, the memory, the user input element, the visual display element, the illuminated alert element, the auditory alert element, and the haptic alert element, the processor configured to determine a heart rate of the user using the first set of output signals, display the heart rate of the user on the visual display element, display the target heart range input on the visual display element, compare the heart rate of the user to the target heart range input within the memory, generate a user alert on at least one of the illuminated alert element, the auditory alert element, and the haptic alert element when the heart rate of the user falls within the target heart range input within the memory, identify repetitive signal patterns within the second set of output signals to generate a count of repetitive movements performed by the user during the fitness activity, and display the count of repetitive movements performed by the user on the visual display element. Moreover, it provides such a fitness-training device that may further comprise a flexible cord wherein the hand-graspable housing may be configured as a hand grip of a jump rope.

A method of providing the fitness-training device is also disclosed herein. The method may comprise the steps of: providing a hand-graspable housing configured to be hand graspable by a user; providing an electronic module disposed within the hand-graspable housing, the electronic fitness-training module including a heart-beat sensor configured to produce a first set of output signals 101 corresponding to heart beats of the user, a movement sensor configured to produce a second set of output signals corresponding to movement of the user during a fitness activity, a memory configured to store target heart rate range data, a user input element configured to enable the user to input a target heart rate range within the memory, a visual display element configured to display visual information, an illuminated alert element configured to provide an illuminated visual alert discernable by the user, an auditory alert element configured to provide an auditory alert discernable by the user, a haptic alert element configured to provide a haptic alert discernable by the user, a processor communicably coupled to the heart-beat sensor, the movement sensor, the memory, the user input element, the visual display element, the illuminated alert element, the auditory alert element, and the haptic alert element; and configuring the processor to determine a heart rate of the user using the first set of output signals, compare the heart rate of the user to the target heart range input within the memory, generate a user alert on at least one of the illuminated alert element, the auditory alert element, and the haptic alert element when the heart rate of the user falls within the target heart range input within the memory, identify repetitive signal patterns within the second set of output signals to generate a count of repetitive movements performed by the user during the fitness activity, and display the count of repetitive movements performed by the user on the visual display element.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a fitness training system and method, constructed and operative according to the teachings of the present disclosure.

The various embodiments of the present invention will hereinafter be described in conjunction with the appended drawings, wherein like designations denote like elements.

DETAILED DESCRIPTION

Figure 1:
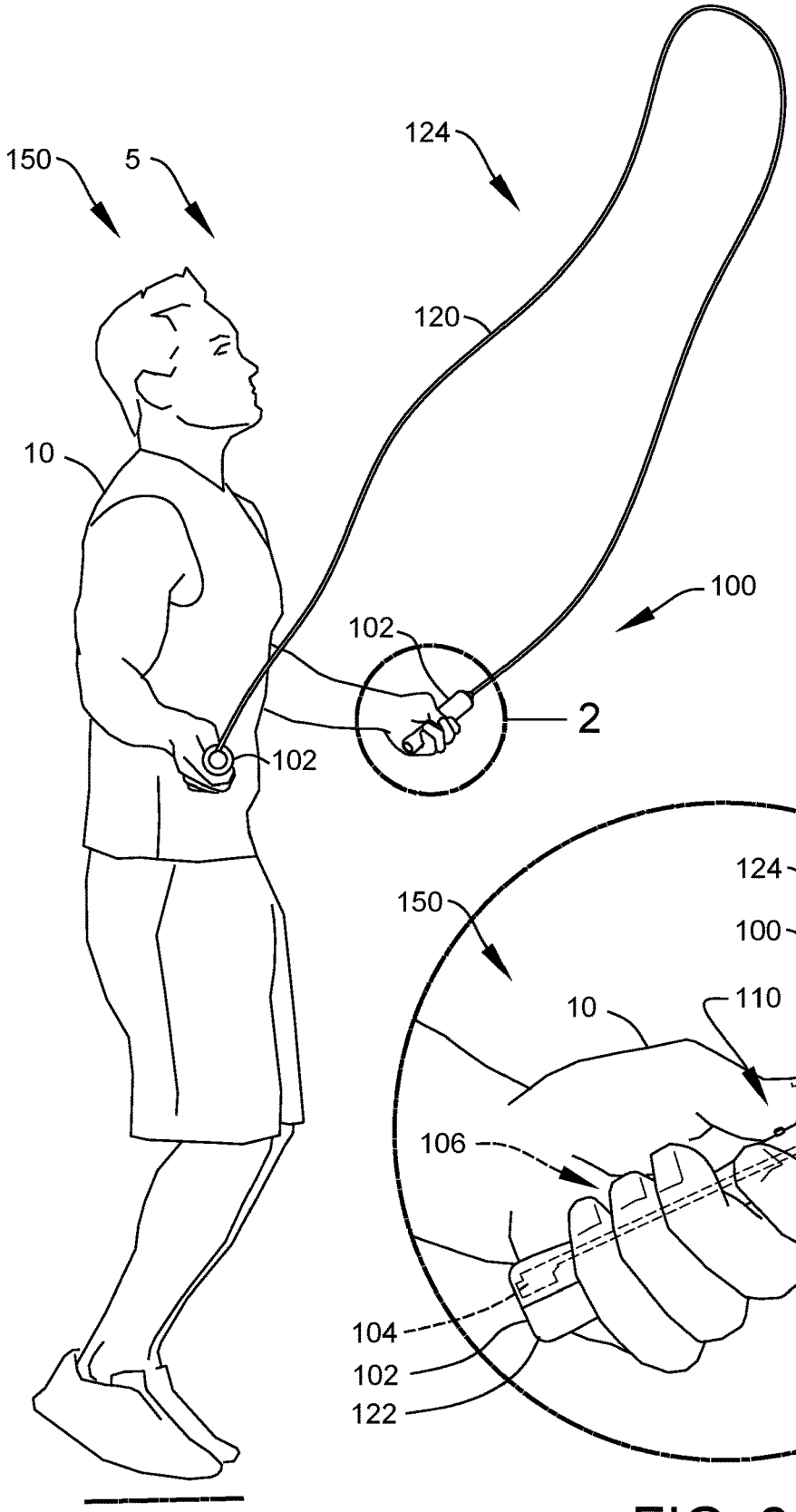
FIG. 1 is a front perspective view of the fitness-training device during an 'in-use' condition, according to an embodiment of the disclosure.

As discussed above, embodiments of the present disclosure relate to a fitness-training device providing heart rate and activity data during use and more particularly to a fitness training system and method as used to improve the a fitness-training device embedded within a graspable handle of an exercise apparatus, the fitness-training device may include a heart rate detector, a repetitive motion counter, and indicators to indicate the user's heart rate, and repetitive motion count during an exercise activity.

Generally, the system described herein is a modified handle of an exercise apparatus with a heart rate sensor built into at least one of the handles. The device may include a small digital display screen on one of the handles designed to notify the user of their heart rate while the device is being used. It allows individuals to program a pre-set target heart rate into the display screen in which an audible beep will sound should the user reach their target heart rate while exercising. The device offers a way for individuals to exercise more efficiently and work at a pace that benefits and accommodates the user. The present invention eliminates the need to constantly use basic cardio machines such as treadmills and elliptical training apparatus in order to work out cardiovascular health.

In one implementation of the system, the device is incorporated within a handle of uniquely-designed jump rope featuring heart rate sensors equipped on or both of the graspable handles of the apparatus. A digital display screen may be installed on one handle, which is designed to show the user's current and target heart rates. Further, the handle may be capable of providing feedback, via an auditory beep and to vibrate once the user reaches their pre-set target heart rate. Additionally, the handle may include a timer, which allows the user to set and exercise duration and to count revolutions of the rope. Heart rate is measured as long as the user keeps a firm grasp on the handle. The user may view their current and target heart rates at any time using the digital display screen, which updates approximately every five seconds.

In addition to the audible beep upon reaching the correct target range, blinking lights on both sides of the screen may provide a visual alert to the user. Optional weights may also be included for increasing difficulty of the jump rope exercises.

Users may grasp the handles and perform cardiovascular jump rope exercises as desired. Heart rate is measured as long as the user keeps a firm grasp on the handles. Users may view their current and target heart rates at any time using the digital display screen. The system is intended to improve cardiovascular workouts and ensures individuals are meeting their target heart rates for various fitness goals.

The system is intended to improve cardiovascular workouts and ensures individuals are meeting their target heart rates for various fitness goals. The entire system may be powered via a rechargeable battery using a Universal Serial Bus (USB) connection to charge. Additionally, the jump rope handle may be capable of communicating with a smartphone application allowing users to transmit their heart rate readings to the application for further observation. This communication may be implemented using wireless Bluetooth technology. The primary functional elements of the system are supported within an electronic board. This board is designed to transmit the information from a person's hand to the handle for displaying the heart rate result on the screen. The board is contained within a graspable handle (i.e., a housing containing the board) to create an innovative handle grip, which can be used to read pulse with and without its attachment to a sports apparatus. Exact size, measurement, construction, and design specifications may vary upon manufacturing.

Figure 2:
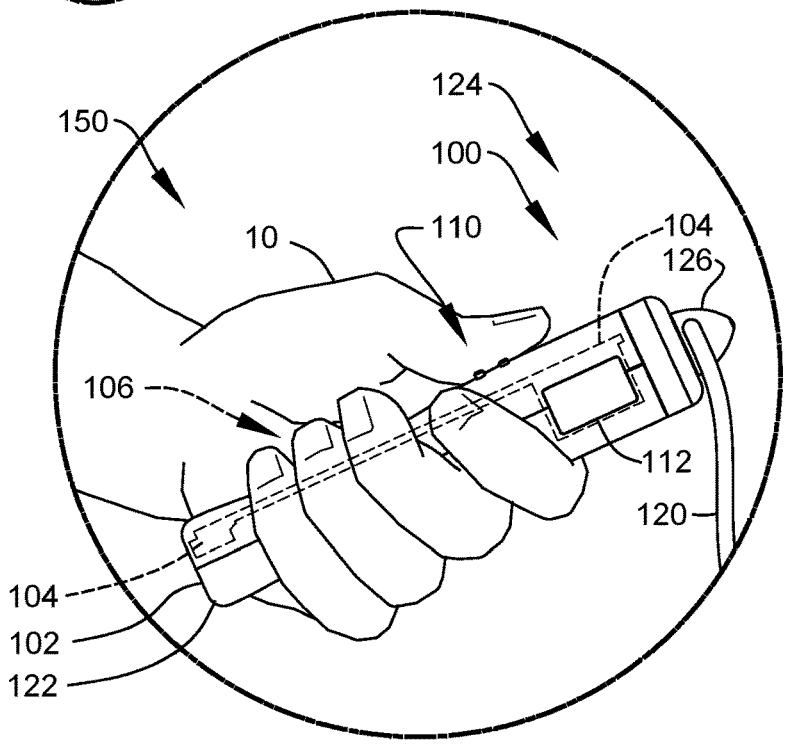
FIG. 2 is the detail view 2 of FIG. 1, enlarged for clarity of description, according to an embodiment of the disclosure.

Referring now more specifically to the drawings by numerals of reference, there is shown in FIGS. 1-18, various views of a fitness-training device 100. FIG. 1 shows the fitness-training device 100 during an 'in-use' condition 150, according to an embodiment of the present disclosure. FIG. 2 is the detail view 2 of FIG. 1, enlarged for clarity.

As illustrated, the fitness-training device 100 may include a hand-graspable housing 102 configured to be hand graspable by a user 10. The hand-graspable housing 102 may be a part of sports and fitness apparatus. By way of example, the hand-graspable housing 102 in the present disclosure is shown as the hand grip 122 of a jump rope 124. It is noted that the fitness-training device 100 may be configured to function as a hand grip of other types of sports and fitness apparatus. Upon reading this specification, it should be appreciated that, under appropriate circumstances, considering such issues as user preferences, demand emphasis within the sport-training marketplace, development of new training apparatus, popularity of alternate training methods, etc., other exercise and fitness apparatus arrangements such as, for example, incorporation of the device within a bicycle handlebar grip, a racquet grip, a baseball/softball bat, a barbell, a resistance band grip, a golf-club grip, a ski pole, the grip of an elliptical machine, an oar grip, a sports glove, etc., may be sufficient.

An electronic module 104 is used to implement the operational features of the fitness-training device 100. The electronic module 104 may be configured to detect the user's heart rate and motion during a training activity and notify the user of their heart rate during use. The electronic module 104 may also allow individuals to program a pre-set target heart rate into the device and to alert the user 10 when a selected target heart rate is reached. The electronic module 104 may also allow individuals to set a time the duration of a workout.

The electronic module 104 may include a printed circuit board located within the interior of the hand-graspable housing 102, as generally indicated by the dashed-line depiction of FIG. 2.

Figure 3:
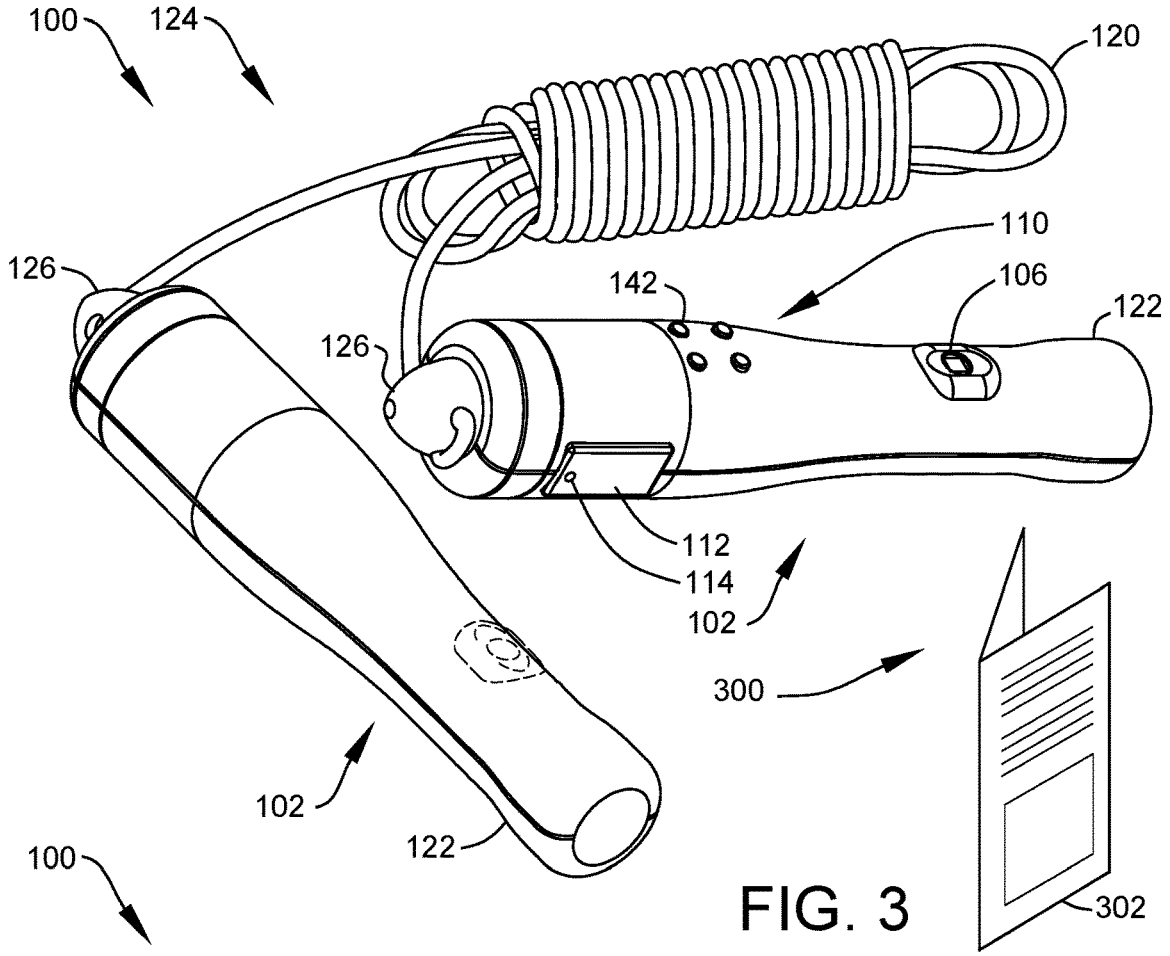
FIG. 3 is a front perspective view of the fitness-training device of FIG. 1, according to an embodiment of the present disclosure.
Figure 4:
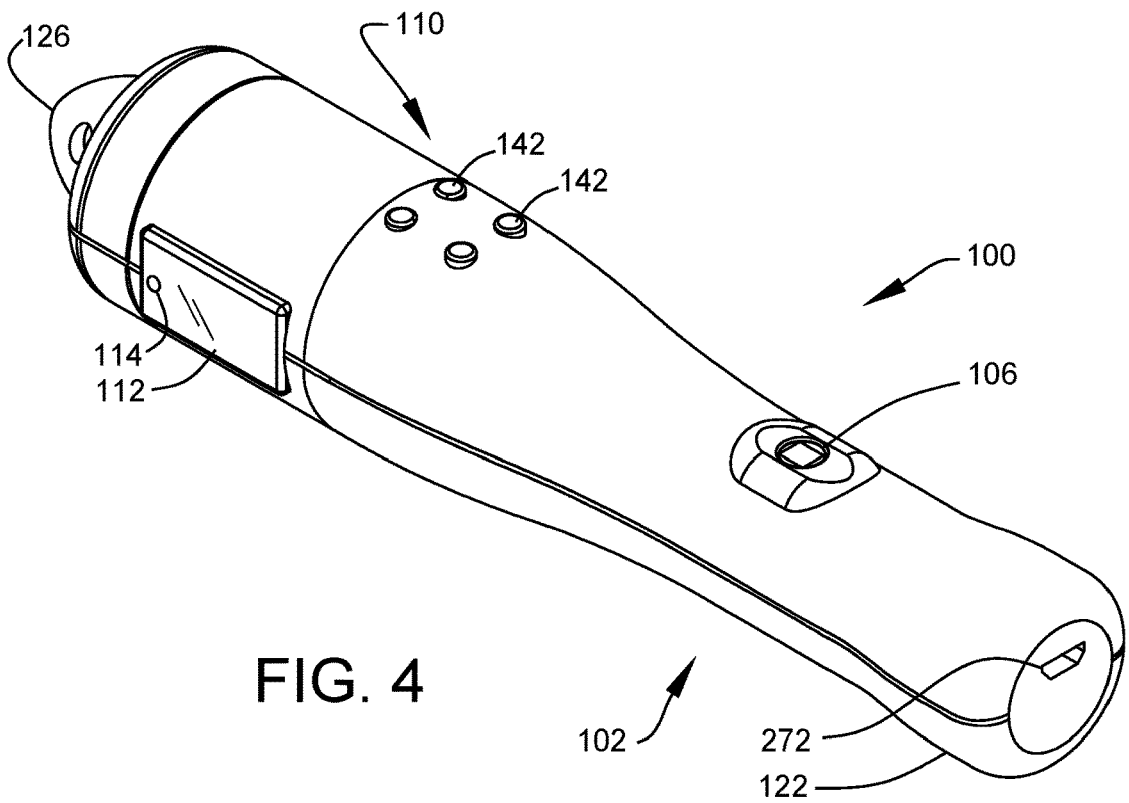
FIG. 4 shows a rear perspective view of a single hand grip of the fitness-training device of FIG. 1, according to an embodiment of the present disclosure.

FIG. 3 shows a front perspective view of the fitness-training device 100 of FIG. 1, according to an embodiment of the present disclosure. FIG. 4 shows a rear perspective view of a single hand grip 122 of the fitness-training device 100 of FIG. 1, according to an embodiment of the present disclosure. As above, the fitness-training device 100 may be configured as a jump rope 124 having a hand-graspable housing 102 identified more specifically herein as hand grip 122. The hand grip 122 may further include an end-mounted swivel 126 adapted to rotationally couple a flexible cord 120 to the hand grip 122, as shown. The swivel 126 may include a set of apertures adapted to receive the flexible cord 120, as shown in FIG. 2. Those with ordinary skill in the art will now appreciate that upon reading this specification and by their understanding the art of flexible cord attachments as described herein, methods of permanently or removably securing the cord to the swivel will be understood by those knowledgeable in such art.

The flexible cord 120 may be constructed from any suitable material, for example natural fibers such as leather, hemp, linen, or cotton, or synthetic materials such as plastic, synthetic rubber, or metallic cable. The cord may be constructed in any suitable configuration having solid or hollow tubular cross sections and can be of any selected length and thickness.

A charge port 272 may be provided within the hand-graspable housing 102, as shown in FIG. 4. The charge port 272 may be configured to allow the charging of an onboard rechargeable battery located within the hand grip 122.

Figure 5:
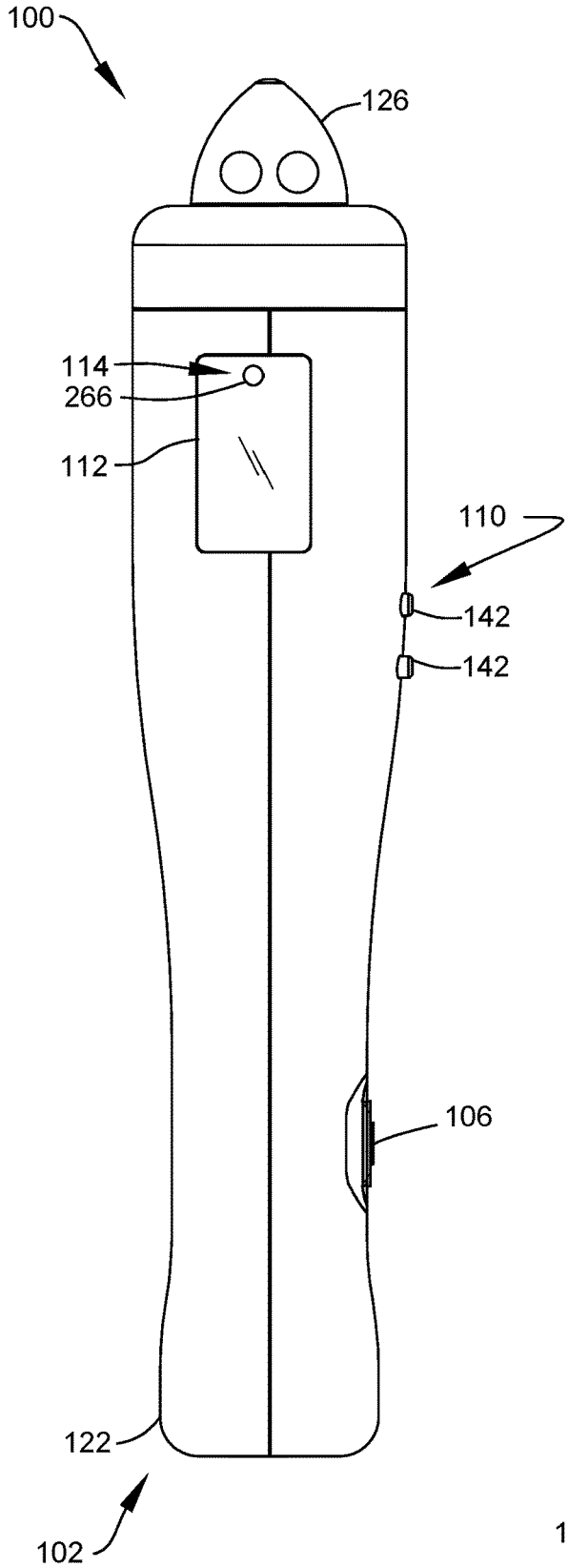
FIG. 5 shows a front view of the hand grip of the fitness-training device of FIG. 1, according to an embodiment of the present disclosure.
Figure 6:
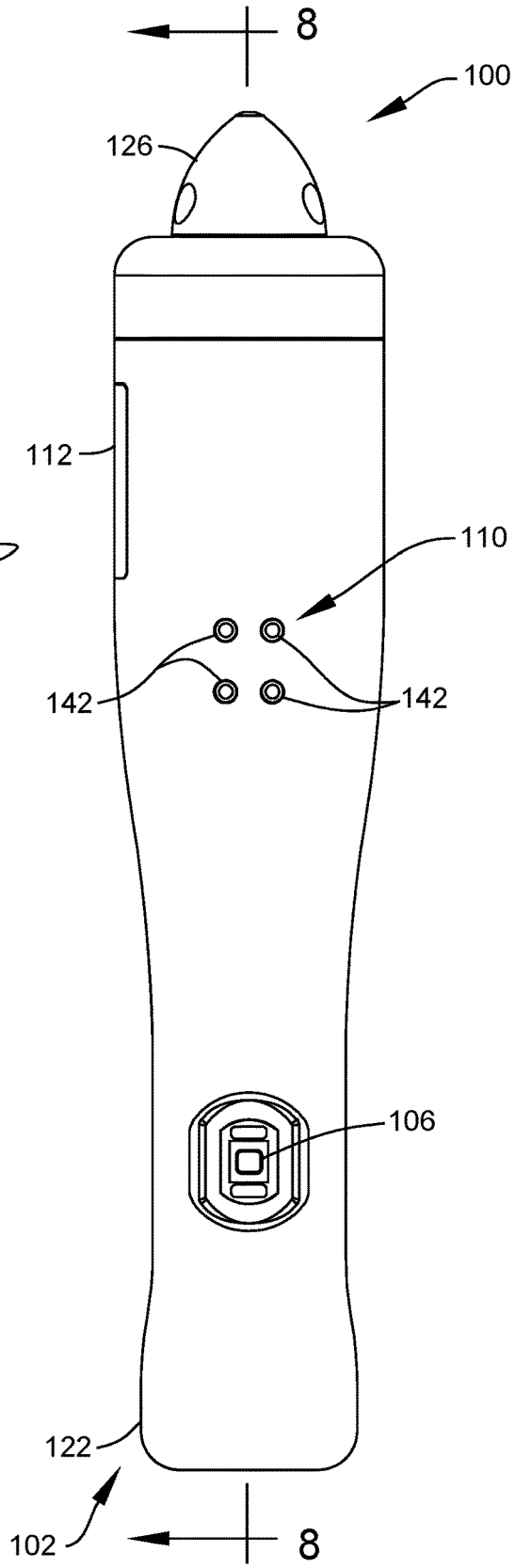
FIG. 6 shows a side view of the hand grip of the fitness-training device of FIG. 1, according to an embodiment of the present disclosure.

FIG. 5 shows a front view of the hand grip 122 of the fitness-training device 100 of FIG. 1, according to an embodiment of the present disclosure. FIG. 6 shows a side view of the hand grip 122 of the fitness-training device 100 of FIG. 1, according to an embodiment of the present disclosure. Visible in FIG. 1 through FIG. 6 is the ergonomic hand-graspable shape of the hand grip 122, the end-mounted swivel 126, a heart-beat sensor 106, a set of user input elements 110, a visual display element 112 and an illuminated alert element 114.

The heart-beat sensor 106 may be positioned within the hand grip 122 to allow optical detection of a user's heart rate through the skin when the user 10 grasps the hand grip (see FIG. 2). The heart-beat sensor 106 may utilize a photoplethysmogram-type heart rate sensor, which utilizes light passing through the skin to optically detect the user's heart rate.

The visual display element 112 is provided to display the user's heart rate, target heart rate, motion count, timer data, and related information. Users may view their current and target heart rates at any time using the visual display element 112. The user 10 may also use the visual display element 112 when programming the device using the user input element 110. A preferred position of the visual display element 112 is shown; however, the visual display element 112 may be positioned anywhere on the grip that is visible to the user during use.

The user input element 110 may include a set of buttons located on the exterior of the housing, as shown. In the present disclosure, the buttons are four momentary-contact switches 142 arranged to allow the user to interact with the electronic module 104 for configuration and power ON/OFF.

The illuminated alert element 114 may function to indicate the status of the device. The illuminated alert element 114 may include a light-emitting diode (LED 266), as shown. The LED 266 may be located at any position on the grip visible to the user during use. As noted above, the LED 266 may be programmed to flash as a signal to the user 10 that a physiological or operational state has been achieved, for example, a target heart rate has been reached, a timed workout duration has been completed, etc.

Figure 7:
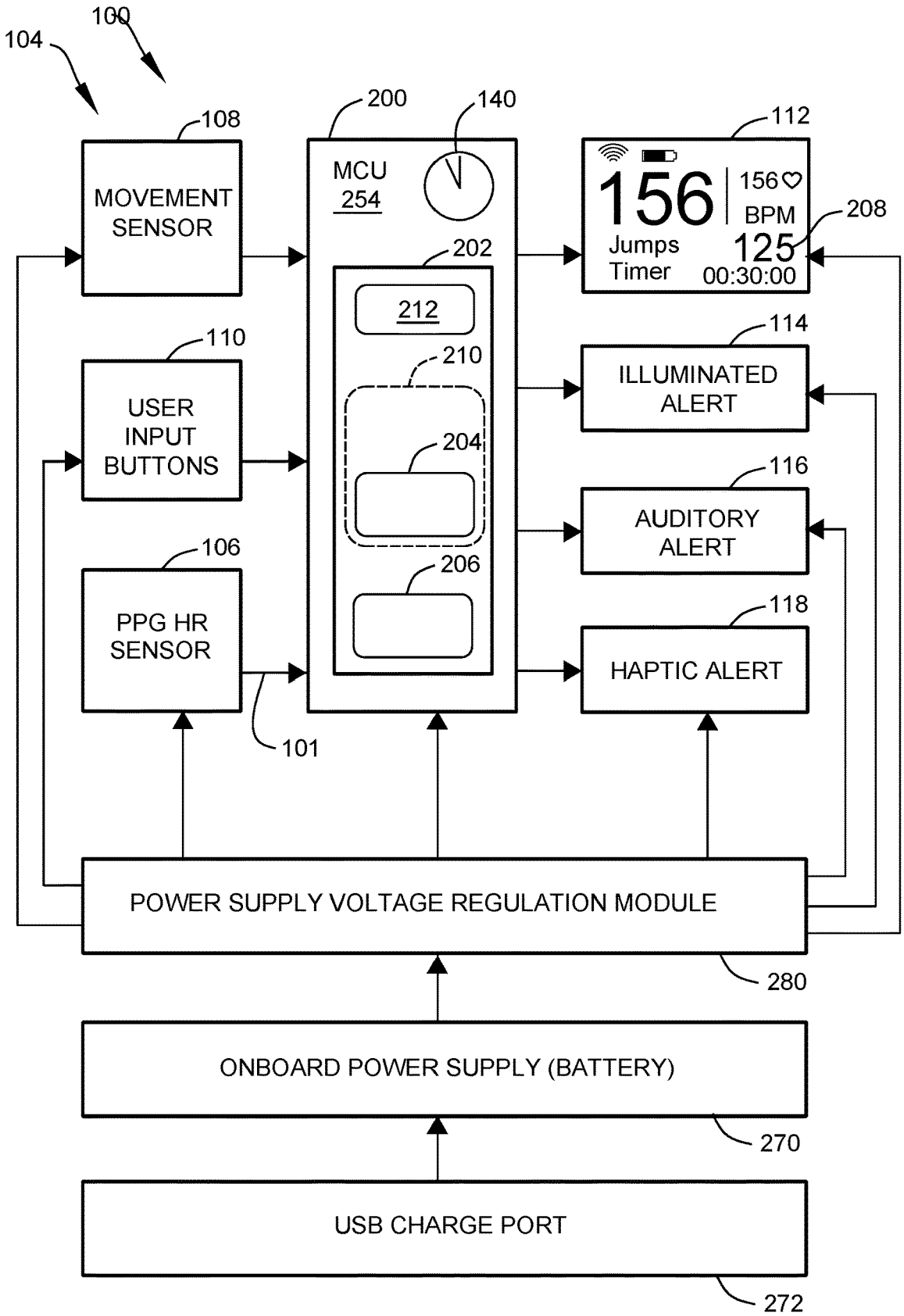
FIG. 7 is a schematic block diagram generally illustrating preferred relationships between the operational elements of an electronic module of the fitness-training device of FIG. 1, according to an embodiment of the present disclosure.

FIG. 7 shows a schematic block diagram generally illustrating preferred relationships between the operational elements of the electronic module 104. In specific reference to FIG. 7, the electronic module 104 may include a processor 200, onboard memory 202, the heart-beat sensor 106, a movement sensor 108, the user input element 110, the visual display element 112, the illuminated alert element 114, an auditory alert element 116, a haptic alert element 118, and an electrical power supply 144 configured to power the components of the electronic module 104, as shown.

The processor 200 may be communicably coupled to the heart-beat sensor 106, the movement sensor 108, the user input element 110, the visual display element 112, the illuminated alert element 114, the auditory alert element 116, and the haptic alert element 118. The onboard memory 202 may be configured to store target heart rate range data 204 along data input by the user 10 using the user input element 110. In one implementation of the system, the user input element 110 is configured to enable the user 10 to input a target heart rate range 206 within the memory 202.

The heart-beat sensor 106 may be configured to produce a first set of output signals 101 corresponding to heart beats of the user 10. As above, the heart-beat sensor 106 may be positioned within the hand grip 122 to allow generation of a first set of output signals 101 when the user 10 grasps the hand grip 122 (see FIG. 2). The processor 200 may be configured to determine a heart rate of the user 10 using the first set of output signals 10. The processor 200 may be configured to display the heart rate of the user 10 on the visual display element 112.

In one implementation of the present system, the processor 200 compares the heart rate of the user 10 to the target heart range 206 input within the memory 202. In this arrangement, the processor 200 may be configured to generate a user alert on one or more of the alert elements (i.e., the illuminated alert element 114, the auditory alert element 116, and the haptic alert element 118) when the heart rate of the user 10 falls within the target heart range 206 input within the memory 202.

In another implementation of the present system, the memory 202 may include a pre-defined dataset 210 containing the target heart rate range data 204. In this arrangement, the user input element 110 may be configured to receive user inputs defining a target heart rate range 206 selected from the pre-defined dataset 210.

The movement sensor 108 may be configured to produce a second set of output signals 103 corresponding to movement of the user 10 during a fitness activity 5. In one implementation of the present system, the processor 200 may be configured to identify repetitive signal patterns within the second set of output signals 103. The processor 200 may use one or more program algorithms 212 to generate a count of repetitive movements 208 performed by the user 10 during the fitness activity 5 (see FIG. 1) and display the count of repetitive movements 208 on the visual display element 112. For example, the movement sensor 108 may be configured to detect the rotation of the swivel 126 and flexible cord 120. The processor 200 may use the output of the movement sensor 108 to calculate the number complete rotations of the swivel 126 and flexible cord 120 and displaying the count of repetitive movements 208 on the visual display element 112. Upon reading this specification, it should be appreciated that, under appropriate circumstances, considering such issues as apparatus type, design preference, data requirements, technological advances, etc., other movement-tracking arrangements such as, for example, counting other repetitive actions, steps, travel distances, jumps, etc., may be sufficient.

In another implementation of the present system, the processor 200 may include a timer 140 to time a duration of the fitness activity 5. The user input element 110 may be used to receive user inputs defining the duration of the fitness activity 5. In this arrangement, the processor 200 may be configured to generate a user alert on one or more of the alert elements (i.e., the illuminated alert element 114, the auditory alert element 116, and the haptic alert element 118) when the duration of the fitness activity 5 is completed.

Figure 8:
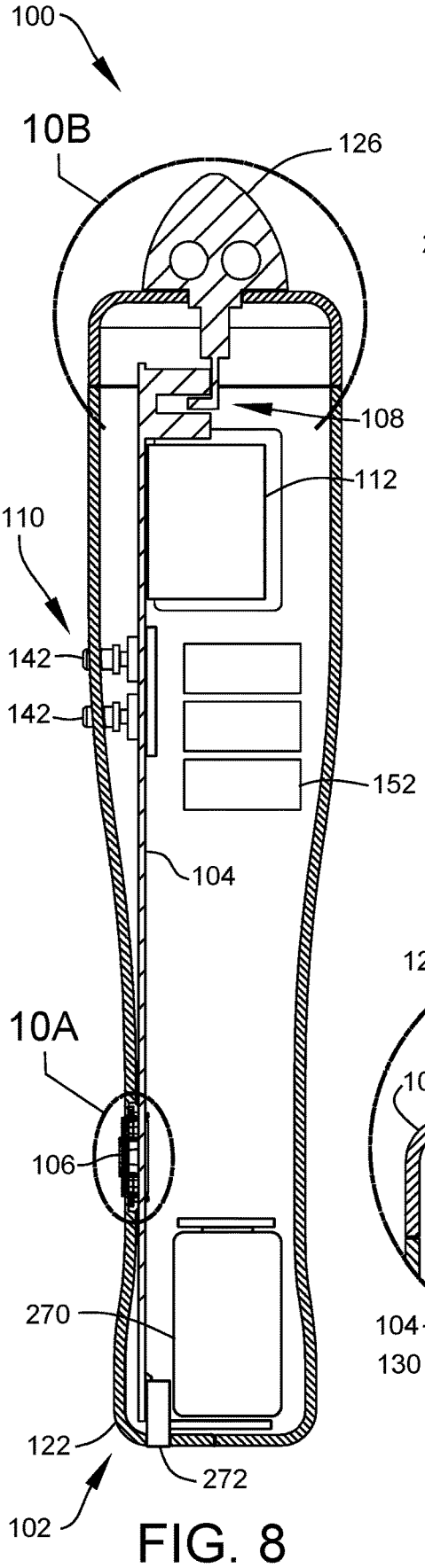
FIG. 8 is a sectional view through the section 8-8 of FIG. 6, according to an embodiment of the present disclosure.
Figure 9:
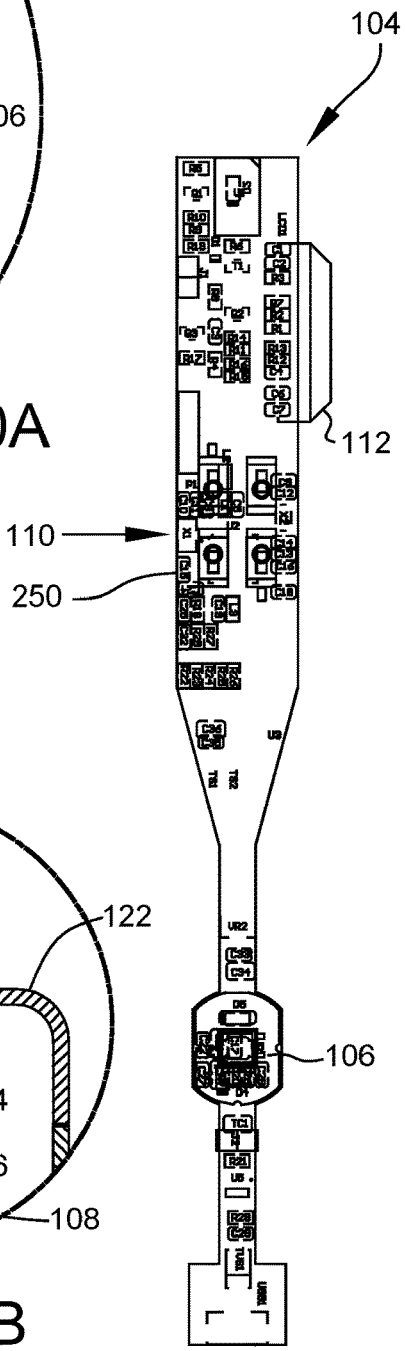
FIG. 9 is a top view of a printed circuit board forming the electronic module of the fitness-training device of FIG. 1, according to an embodiment of the present disclosure.

FIG. 8 is a sectional view through the section 8-8 of FIG. 6, according to an embodiment of the present disclosure. FIG. 9 is a top view of a printed circuit board forming the electronic module 104, according to an embodiment of the present disclosure. In one implementation of the present system, hand-graspable housing 102 forming the hand grip 122 may consist of a rigid shell formed from a rugged and durable molded plastic. The shell may be formed in two or more parts to allow for the convenient placement of the interior components during fabrication. Optional weights 152 may be included within the hand grip 122 for increasing the difficulty of exercises performed using the device.

The outer surface of the hand grip 122 may include a smooth finish, as shown. In alternate versions of the present system, the outer surface may include a fictional surface to improve grip. A preferred color may be provided to the outer surface by coating, mixing or blending the material forming the outer surface with a pigment and/or dye, or by other well-known methods. Upon reading this specification, it should be appreciated that, under appropriate circumstances, considering such issues as user preferences, design preference, marketing preferences, cost, available materials, available printing techniques, etc., the use of other visual elements such as, for example, differing surface textures, printed text, graphic depictions, symbols, corporate branding, team logos, etc., may be sufficient.

The electronic module 104 may comprise a single printed circuit board (PCB 250) mounted within the interior of the hand grip 122, as shown. The PCB 250 may be positioned adjacent an outer wall of the hand grip 122 to allow the heart-beat sensor 106, the visual display element 112 and the four momentary-contact switches 142 to extend from the surface of the PCB 250 to positions near or passing through the outer wall of the hand grip 122, as shown.

Figure 10A:
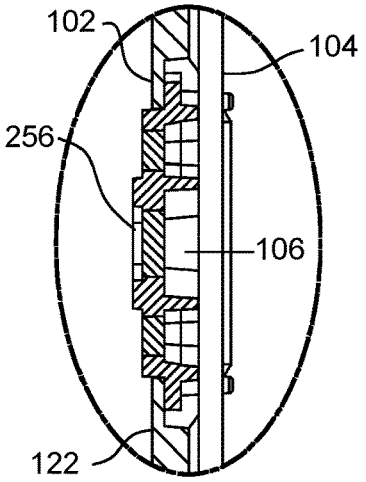
FIG. 10A is the enlarged sectional view 10A of FIG. 8, illustrating an operable arrangement of a heart-beat sensor of the fitness-training device of FIG. 1, according to an embodiment of the present disclosure.

FIG. 10A is the enlarged sectional view 10A of FIG. 8, illustrating an operable arrangement of the heart-beat sensor 106 within the hand grip 122, according to an embodiment of the present disclosure. The heart-beat sensor 106 may include a clear lens 256 extending through the outer wall of the hand grip 122, as shown. Alternately, the clear lens 256 may be integrated within the outer wall of the hand grip 122 in a location over the heart-beat sensor 106 mounted on the PCB 250.

Figure 10B:
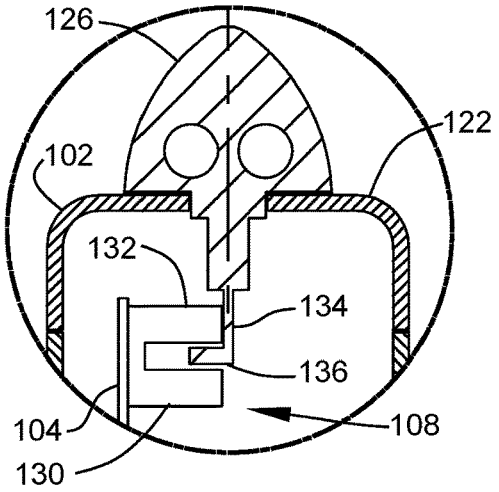
FIG. 10B is the enlarged sectional view 10B of FIG. 8, illustrating an operable arrangement of the movement sensor of the fitness-training device of FIG. 1, according to an embodiment of the present disclosure.

FIG. 10B is the enlarged sectional view 10B of FIG. 8, illustrating an operable arrangement of the end-mounted swivel 126 and the movement sensor 108, according to an embodiment of the present disclosure. As noted above, the movement sensor 108 may be configured to sense rotational motion of the swivel 126 and flexible cord 120 joined to the swivel 126 during the fitness activity 5.

In one arrangement of the system, a rotational shaft 134 is joined with the swivel 126, as shown. In this arrangement, the rotational shaft 134 extends from the base of the swivel 126 inwardly toward the interior of the hand grip 122, as shown. Both the rotational shaft 134 and the swivel 126 are arranged to rotate freely within the hand grip 122.

The movement sensor 108 includes a light source 130 and a photo detector 132 positioned to receive light emitted by the light source 130. The rotational shaft 134 may include a small optically-opaque wiper panel 136 projecting outwardly from the distal end of the shaft, as shown. The wiper panel 136 may be configured to pass between the light source 130 and the photo detector 132 to interrupt the light passing between the light source 130 and the photo detector 132 at least once during a complete rotation of the rotational shaft 134 and swivel 126. Interruption of the light received at photo detector 132 produces variations in the second set of output signals 103 produced by the movement sensor 108. As noted above, the processor 200 may be configured to identify repetitive signal patterns within the second set of output signals 103 to generate a count associated with repetitive motions performed during the fitness activity 5.

Figure 11:
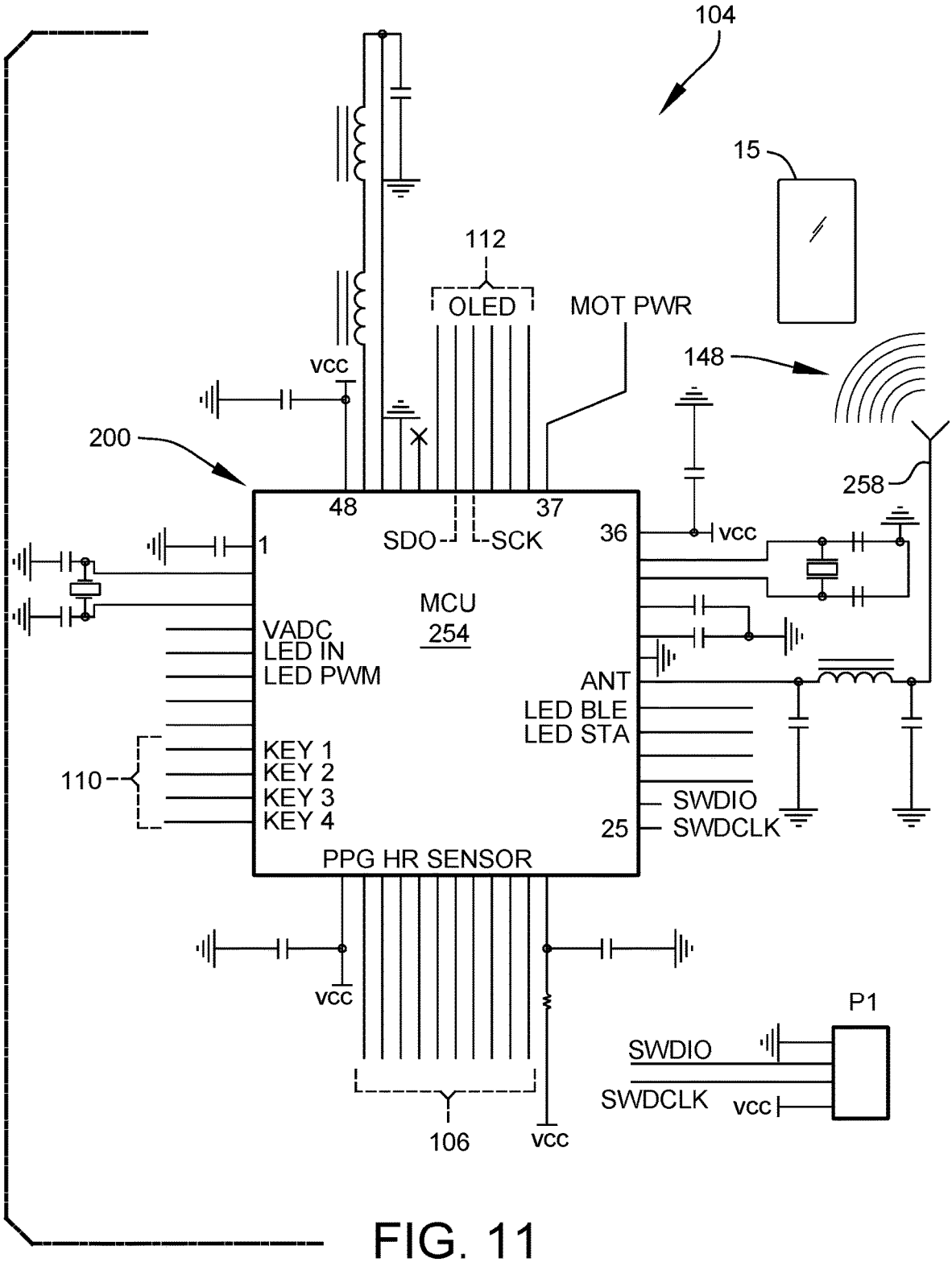
FIG. 11 is a circuit diagram further illustrating arrangements of the electronic module of the fitness-training device of FIG. 1, according to an embodiment of the present disclosure.

FIG. 11 is a circuit diagram further illustrating arrangements of the electronic module 104, according to an embodiment of the present disclosure. In one implementation of the system, the processor 200 comprises a general-purpose Microcontroller Unit (generally identified hereinafter as MCU 254). The MCU 254 is the central control block within the electronic module 104. A Microcontroller Unit suitable for use as MCU 254 in the present system may be a model nRF52832 microcontroller by Nordic Semiconductor of Trondheim Norway. The nRF52832 chip includes system-on-chip (SoC) with Bluetooth connectivity and general-purpose microcontroller functionality. This SoC may collect and process data from the heart-beat sensor 106 and movement sensor 108, may communicate with an external wireless mobile device 15 via an internal 2.4 GHz radio (a wireless transceiver 148) using the Bluetooth five protocol, may produce the necessary output signals to control the visual display element 112, and additionally may produce digital and analog output signals to control the haptic alert element 118, indicator LED 266 of the illuminated alert element 114, and movement sensor 108. The MCU block may additionally contain the necessary support electronics to allow the MCU 254 to operate. The support electronics may include power supply decoupling capacitors, two 3.9 nH inductors for the SoC's internal DC/DC buck converter, a 32.768 kHz standby crystal oscillator with associated load capacitors, a 32 MHz clock-timing crystal oscillator with associated load capacitors, and the tuning capacitors and tuning inductor associated with the 2.4 GHz communications antenna 258. Implementation of Bluetooth communication within the MCU 254 allows the MCU 254 to transmit the heart rate of the user 10 to the wireless mobile device 15. Even further, the MCU 254 may be configured to send the count of repetitive movements performed by the user 10 to the wireless mobile device 15. In the present disclosure the term "wireless mobile device" shall be understood to include a wide range of electronic devices, including but not limited to: cell phones, handheld computers, tablets, computing devices small enough to hold and operate in the hand, mobile and stationary devices that can connect to the Internet and interconnect with other devices, headsets, general Wi-Fi devices, general Bluetooth devices, near-field communication (NFC) devices, etc.

Figure 12:
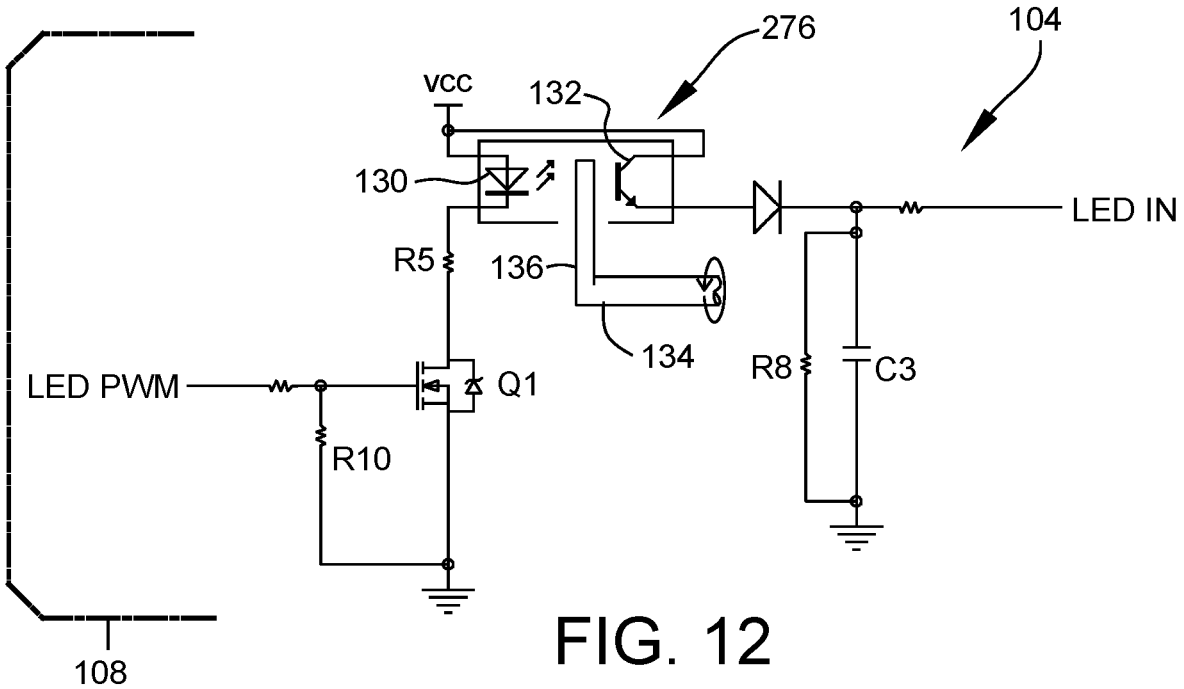
FIG. 12 is a circuit diagram further illustrating arrangements of the electronic module of the fitness-training device of FIG. 1, according to an embodiment of the present disclosure.

FIG. 12 is a circuit diagram further illustrating arrangements of the electronic module 104, according to an embodiment of the present disclosure. As generally described in FIG. 10B, the movement sensor 108 is provided to sense motion associated with a physical activity performed by the user. More particularly, the movement sensor 108 may be configured to detect repetitive motion associated with a sports activity. As above, the movement sensor 108 may be adapted to detect each revolution of the swivel 126 and flexible cord 120. In this configuration, the light source 130 and photo detector 132 of movement sensor 108 may use an optical emitter (LED) and a receiver (phototransistor) pair 276, as shown. The optical emitter/receiver pair 276 is combined with the optically-opaque wiper panel 136 joined to the rotational shaft 134 of the swivel 126 (see FIG. 10B). In one implementation of the system, a pulse-width modulated (PWM) signal is generated by the MCU 254 and is supplied to the gate of 'Q1', an N-channel MOSFET. When a logic-high voltage is applied to the gate of the MOSFET, the MOSFET passes current and the LED activates. 'R5' serves to limit the current passed through the LED and 'R10' is a pulldown resistor to prevent MOSFET conduction when the output of the MCU 254 is high-impedance (i.e., when the MCU 254 is first booting up). The collector of the phototransistor receiver (photo detector 132) is tied to the VCC rail, and its emitter is connected via a diode to a low-pass filter comprised of resistor 'R8' in parallel with capacitor 'C3'. This filter serves to limit the occurrence of false-triggering of the sensor or multiple-triggering of the sensor during one revolution of the swivel 126 and flexible cord 120. The output of the movement sensor 108 is passed to an input pin on the MCU 254.

Figure 13:
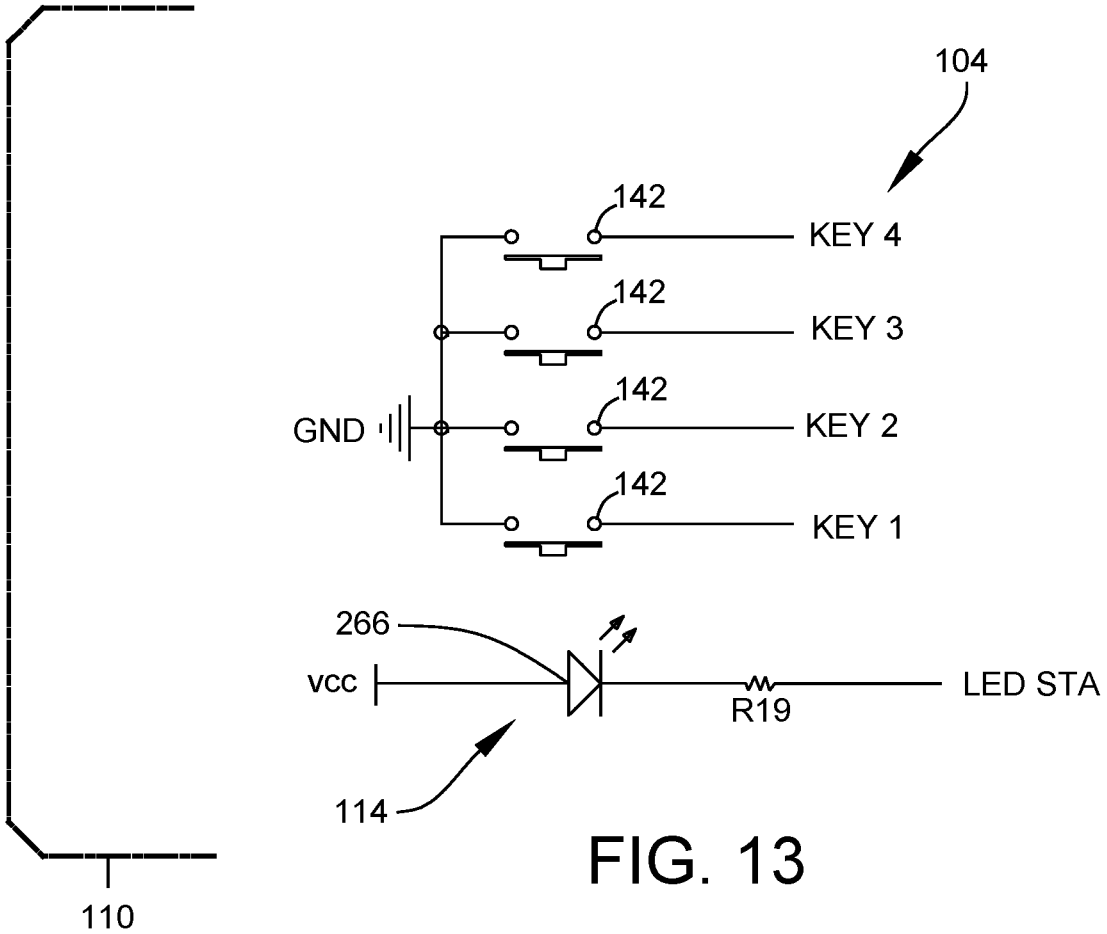
FIG. 13 is a circuit diagram further illustrating arrangements of the electronic module of the fitness-training device of FIG. 1, according to an embodiment of the present disclosure.

FIG. 13 is a circuit diagram further illustrating arrangements of the electronic module 104, according to an embodiment of the present disclosure. Four momentary-contact switches 142 (i.e., button switches) are provided to allow the user to interact with the electronic module 104 for configuration and power ON/OFF. All of these momentary-contact switches 142 are connected to ground (GND) on one side, and each momentary-contact switch 142 is connected to a pin on the MCU 254. The pins on the MCU 254, which are connected to the momentary-contact switches 142, are configured as inputs with the internal pullup resistors of the MCU 254 enabled. When the user presses one or more of the momentary-contact switches 142 this overcomes the internal pullup resistor(s), thereby producing a logic-low value at the respective input(s).

As above, the illuminated alert element 114 may include at least one illuminated indicator provided to indicate the status of the electronic module 104. As above, the illuminated indicators may be a Light Emitting Diode (LED 266).

The anode of the LED 266 is connected to VCC, and current through the LED is limited by the resistor 'R19'. LED 266 is activated by driving an output pin on the MCU 254 to a logic-low state.

Figure 14:
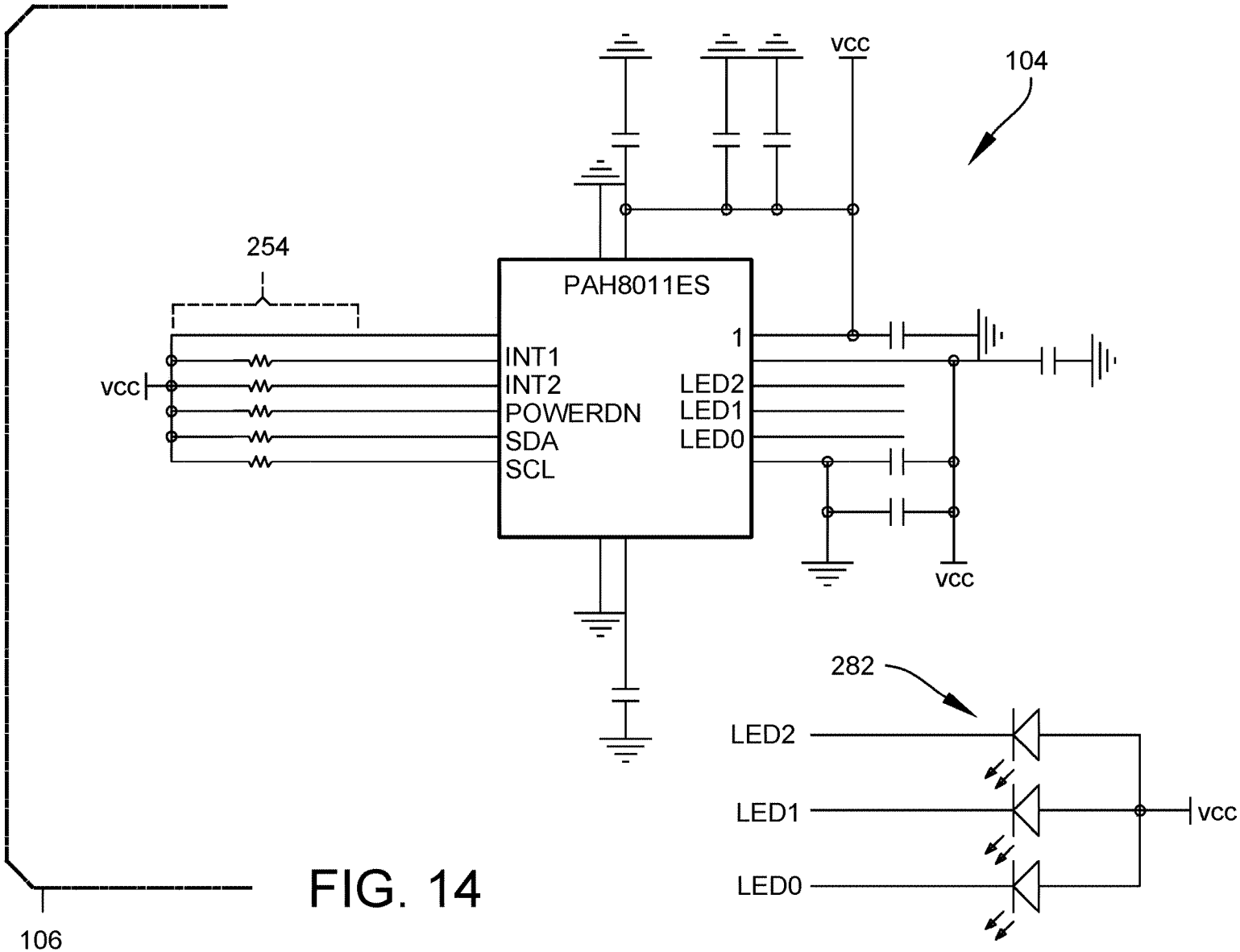
FIG. 14 is a circuit diagram further illustrating arrangements of the electronic module of the fitness-training device of FIG. 1, according to an embodiment of the present disclosure.

FIG. 14 is a circuit diagram further illustrating arrangements of the electronic module 104, according to an embodiment of the present disclosure. The heart-beat sensor 106 may comprise a Photoplethysmogram Heart Rate sensor block, which may utilize an integrated optical heart rate monitoring chip to measure the user's heart rate. An integrated optical heart rate monitoring chip suitable for use in the present electronic module 104 includes model PAH8011ES by PixArt Imaging Inc. of Sunnyvale, Calif. The integrated circuit utilizes three external LEDs 282 controlled by the PAH8011ES to provide illumination of the user's skin and blood vessels and utilizes internal digital signal processing to provide PPG data, which can be used to infer heart rate. Interrupt control pins 'INT1' and 'INT2', enable pin 'POWERDN', and $I^2C$ communication protocol pins 'SDA' and 'SCL' allow the MCU 254 to control the heart-beat sensor 106 and allow the sensor to report data back to the MCU 254. Power supply decoupling capacitors may also be provided on both the digital power input pins and analog power input pins.

Figure 15:
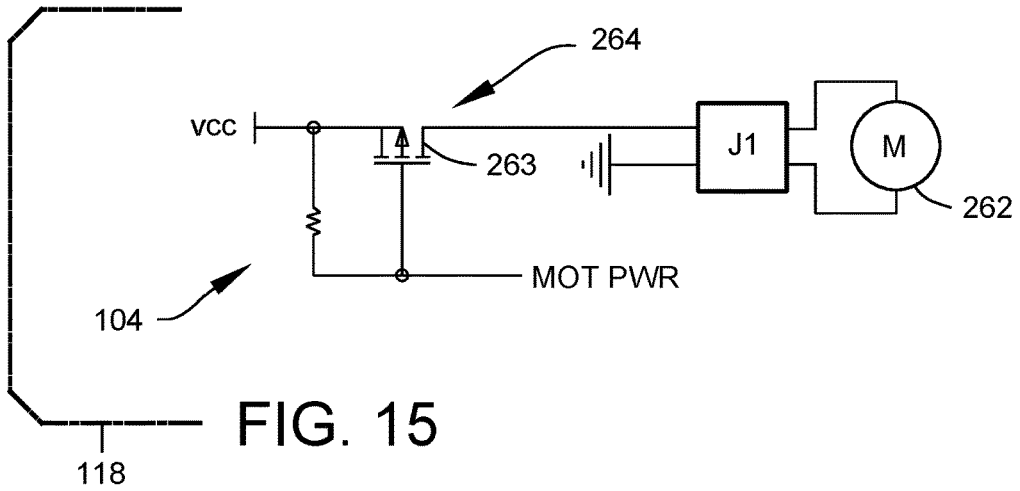
FIG. 15 is a circuit diagram further illustrating arrangements of the electronic module of the fitness-training device of FIG. 1, according to an embodiment of the present disclosure.

FIG. 15 is a circuit diagram further illustrating arrangements of the electronic module 104, according to an embodiment of the present disclosure. The haptic alert element 118 is designed to provide vibratory feedback to alert the user. The haptic alert element 118 may utilize a vibrating motor 262 and vibrating motor control circuit 264 The vibrating motor control circuit 264 may utilize a P-channel MOSFET 263 connected between VCC and the positive input of the vibrating motor 262 to switch the motor 262 on and off electronically. The gate of the MOSFET is connected to a control pin on the MCU 254 and also features a pulldown resistor to ensure that the MOSFET does not conduct current when the MCU 254 is in a high-impedance state. The vibrating motor 262 connects externally to the connector labeled 'J1'. Under appropriate circumstances, a back-EMF protection diode may be installed in parallel to the vibration motor 262 to prevent breakdown in the MOSFET when the motor is switched off. Additionally, a decoupling capacitor may be placed in close proximity to the vibrating motor 262 control circuit to prevent electrical noise from being introduced onto the 3.3V rail when the motor 262 is operating.

Figure 16:
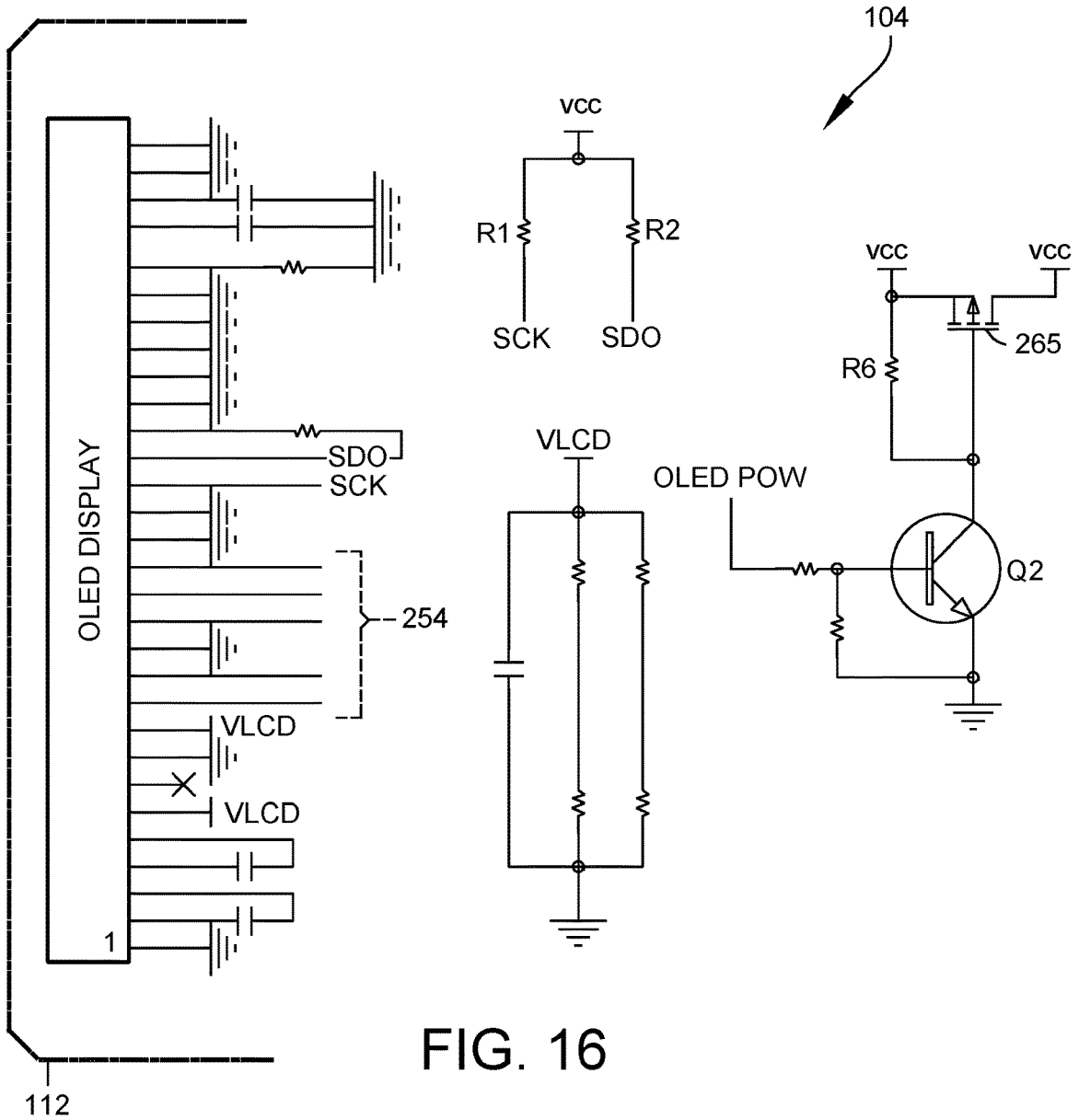
FIG. 16 is a circuit diagram further illustrating arrangements of the electronic module of the fitness-training device of FIG. 1, according to an embodiment of the present disclosure.

FIG. 16 is a circuit diagram further illustrating arrangements of the electronic module 104, according to an embodiment of the present disclosure. The visual display element 112 provides visual information to the user from the electronic module 104. In one implementation of the system, the visual display element 112 is an OLED (organic light-emitting diode) display. The visual display element 112 may be connected to the PCB 250 via a 30-pin connector and manufacturer-recommended power supply decoupling/filtering capacitors and resistors may be provided. A Serial Peripheral Interface (SPI) protocol is used by the MCU 254 to send graphical data to the visual display element 112 via 'SCK' and 'SD0'. Two pullup resistors (R1 and R2) are used to pull the SPI control lines to VCC when not in use. Power to the visual display element 112 is supplied via a P-channel MOSFET 265 whose gate is pulled to VCC by pullup resistor 'R6' when not in use and whose gate is pulled to logic-low by the BJT 'Q2' when the MCU 254 requests power to the display.

Figures 17, 18:
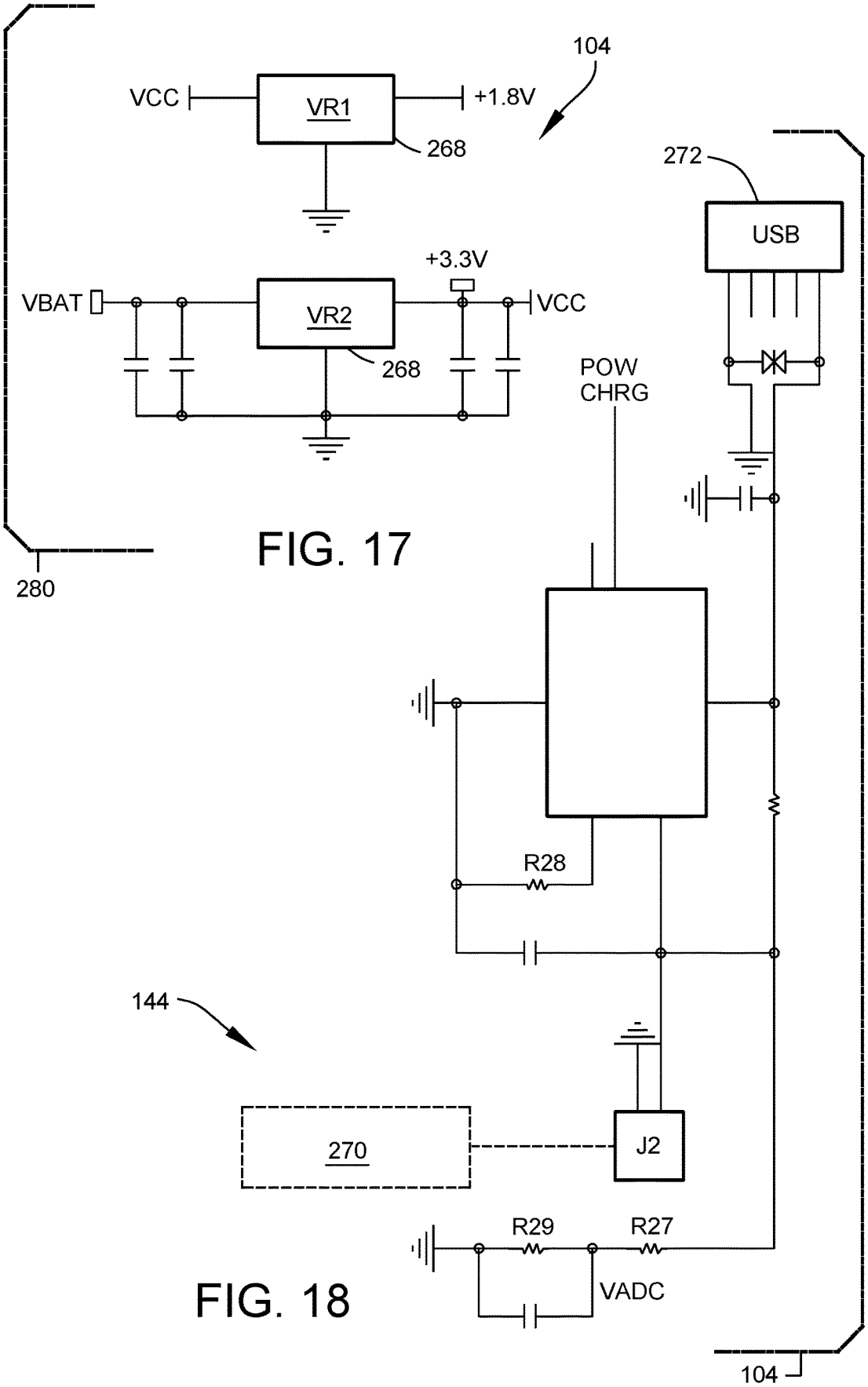
FIG. 17 is a circuit diagram further illustrating arrangements of the electronic module of the fitness-training device of FIG. 1, according to an embodiment of the present disclosure.
FIG. 18 is a circuit diagram further illustrating arrangements of the electronic module of the fitness-training device of FIG. 1, according to an embodiment of the present disclosure.

FIG. 17 is a circuit diagram illustrating a power supply voltage regulation module 280 of the electronic module 104, according to an embodiment of the present disclosure. The system includes two linear voltage regulators 268 that are provided to regulate the power supply voltage from the battery. This ensures that the appropriate DC voltage value is provided to all components in the electronic module 104 and that voltage ripple and/or transients are kept within tolerable limits on these voltage supplies. 'VR1' is an XC6206P182 positive-voltage regulator with a specified output voltage of 1.8V. It is principally used to power the PAH8011ES PPG HR sensor unit. 'VR2' is a 3.3V positive-voltage regulator which provides the general-purpose 3.3V supply rail to most of the components within the device.

FIG. 18 is a circuit diagram further illustrating arrangements of the electronic module 104, according to an embodiment of the present disclosure. The charge port 272 may be supplied as a micro USB port provided to allow an external USB power source to be connected to the electronic module 104. In one implementation of the present system, the data pins are left floating. A TVS (transient voltage suppression) device may be included to mitigate damage due to voltage spikes at the USB input. The USB supply bus may be routed to a TP4059 lithium ion charge control IC which may utilize constant-current and constant-voltage output regulation to charge at least one rechargeable onboard battery 270 (the electrical power supply 144). In one implementation of the present system, the rechargeable onboard battery 270 may be a rechargeable lithium-ion cell. The charge current is selected using 'R28' and is selectable up to 600 mA. Additionally, a voltage divider comprised of 'R27' and 'R29' is employed to supply the ADC reference voltage 'VADC' utilized by the MCU 254. Manufacturer-recommended decoupling capacitors are included. The rechargeable onboard battery 270 may be connected to the device via the connector 'J2' for portable use of the device. A suitable cell capacity may be about 120 mAh. Upon reading this specification, it should be appreciated that, under appropriate circumstances, considering such issues as user preferences, design preference, structural requirements, marketing preferences, cost, available materials, technological advances, etc., other port arrangements such as, for example, coupling the port to the processor via a serial translator to all data communication between the port and the processor, etc., may be sufficient.

According to one embodiment, the fitness-training device 100 may be arranged as a kit 300. Referring again to FIG. 3, the kit 300 may include the fitness-training device 100 along with a set of instructions 302. The instructions 302 may detail functional relationships in relation to the structure of the fitness-training device 100 (such that the fitness-training device 100 can be used, maintained, or the like, in a preferred manner).

Figure 19:
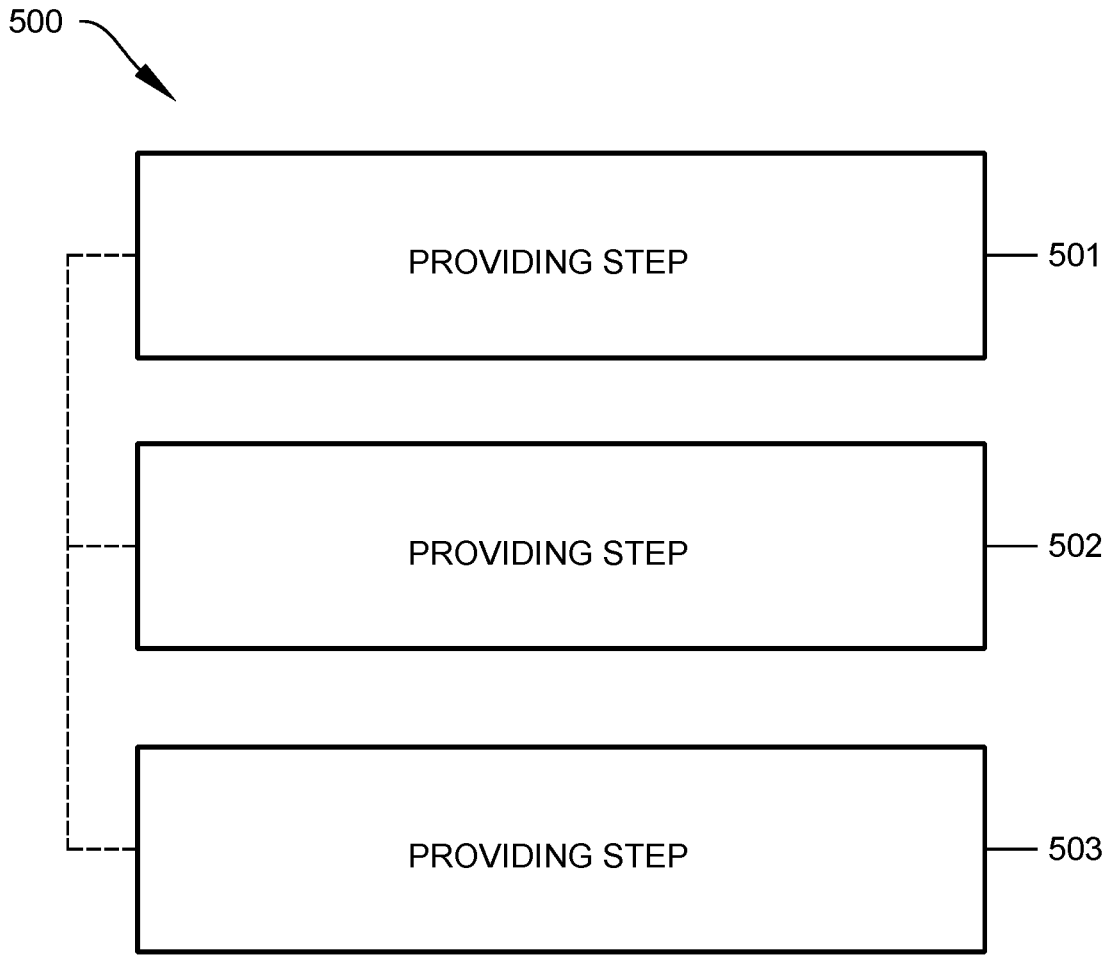
FIG. 19 is a flow diagram illustrating a method relating to providing the fitness-training device, according to an embodiment of the present disclosure.

FIG. 19 is a flow diagram illustrating a method 500 relating to the construction of a fitness-training device, according to an embodiment of the present disclosure. As illustrated, and with continued reference to the prior figures, the method 500 may include the steps of: step one 501, providing a hand-graspable housing 102 configured to be hand graspable by a user; and step two 502, providing an electronic module 104 disposed within the hand-graspable housing 102, the electronic fitness-training module may include a heart-beat sensor 106 configured to produce a first set of output signals 101 corresponding to heart beats of the user 10, a movement sensor 108 configured to produce a second set of output signals 103 corresponding to movement of the user 10 during a fitness activity 5, a memory 202 configured to store target heart rate range data 204, a user input element 110 configured to enable the user 10 to input a target heart rate range 205 within the memory 202, a visual display element 112 configured to display visual information, an illuminated alert element 114 configured to provide an illuminated visual alert discernable by the user 10, an auditory alert element 116 configured to provide an auditory alert discernable by the user 10, a haptic alert element 118 configured to provide a haptic alert discernable by the user 10, a processor 200 communicably coupled to the heart-beat sensor 106, the movement sensor 108, the memory 202, the user input element 110, the visual display element 112, the illuminated alert element 114, the auditory alert element 116, and the haptic alert element 118; and configuring the processor 200 to determine a heart rate of the user 10 using the first set of output signals 101, compare the heart rate of the user 10 to the target heart range input within the memory 202, generate a user alert on at least one of the illuminated alert element 114, the auditory alert element 116, and the haptic alert element 118 when the heart rate of the user 10 falls within the target heart range input within the memory 202, identify repetitive signal patterns within the second set of output signals 103 to generate a count of repetitive movements performed by the user 10 during the fitness activity 5, and display the count of repetitive movements performed by the user 10 on the visual display element 112.

Even further, method 500, may comprise the step of: step three 503, providing a wireless transceiver 148 within the electronic module 104, the wireless transceiver 148 configured to wirelessly communicate with a wireless mobile device 15; and configuring the processor 200 to transmit the heart rate of the user 10 to the wireless mobile device 15 using the wireless transceiver 148.

It should be noted that step 503 is an optional step and may not be implemented in all cases. Optional steps of method 500 are illustrated using dotted lines in FIG. 19 so as to distinguish them from the other steps of method 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for providing the fitness-training device 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A fitness-training device comprising:

a hand-graspable housing configured to be hand graspable by a user;

an electronic module disposed within the hand-graspable housing, the electronic module including a heart-beat sensor configured to produce a first set of output signals corresponding to heart beats of the user, a movement sensor configured to produce a second set of output signals corresponding to movement of the user during a fitness activity, a memory configured to store target heart rate range data, a user input element configured to enable the user to input a target heart rate range within the memory, a visual display element configured to display visual information, an illuminated alert element configured to provide an illuminated visual alert discernable by the user, an auditory alert element configured to provide an auditory alert discernable by the user, a haptic alert element configured to provide a haptic alert discernable by the user, a processor communicably coupled to the heart-beat sensor, the movement sensor, the memory, the user input element, the visual display element, the illuminated alert element, the auditory alert element, and the haptic alert element, the processor configured to determine a heart rate of the user using the first set of output signals, display the heart rate of the user on the visual display element, display the target heart range input on the visual display element, compare the heart rate of the user to the target heart range input within the memory, generate a user alert on at least one of the illuminated alert element, the auditory alert element, and the haptic alert element when the heart rate of the user falls within the target heart range input within the memory, identify repetitive signal patterns within the second set of output signals to generate a count of repetitive movements performed by the user during the fitness activity, and display the count of repetitive movements performed by the user on the visual display element; and a flexible cord wherein the hand-graspable housing is configured as a hand grip of a jump rope.

2. The fitness-training device of claim 1, wherein the heart-beat sensor comprises a photoplethysmogram-type heart rate sensor; and the heart-beat sensor is positioned within the hand grip to allow generation of the first set of output signals when the user grasps the hand grip.

3. The fitness-training device of claim 2, wherein the hand grip further comprises a swivel adapted to rotationally couple the flexible cord to the hand grip; and the movement sensor is configured to sense rotational motion of the flexible cord during the fitness activity.

4. The fitness-training device of claim 3, wherein the movement sensor comprises a light source, a photo detector positioned to receive light emitted by the light source, and a rotational shaft joined with the swivel, the rotational shaft having an opaque panel configured to interrupt the light passing between the light source and the photo detector at least once during a complete rotation of the swivel.

5. The fitness-training device of claim 1, wherein the electronic module further comprises a timer to time a duration of the fitness activity;

the user input element is further configured to receive user inputs defining the duration of the fitness activity; and the processor is further configured to generate a user alert on at least one of the illuminated alert element, the auditory alert element, and the haptic alert element when the duration of the fitness activity is completed.

6. The fitness-training device of claim 1, wherein the visual display element comprises an organic light-emitting diode display.

7. The fitness-training device of claim 1, wherein the illuminated alert element comprises at least one illuminated light-emitting diode.

8. The fitness-training device of claim 1, wherein the haptic alert element comprises a vibrating motor.

9. The fitness-training device of claim 1, wherein the user input element comprises a set of momentary-contact switches.

10. The fitness-training device of claim 1, further comprising a power supply configured to power the electronic module.

11. The fitness-training device of claim 1, wherein the power supply comprises at least one rechargeable battery; and the hand-graspable housing further comprises a charge port configured to couple with an electrical power source useable to charge the rechargeable battery.

12. The fitness-training device of claim 1, wherein the memory further includes a pre-defined dataset comprising target heart-rate range data; and the user input element is further configured to receive user inputs defining a target heart rate range selected from the pre-defined dataset.

13. The fitness-training device of claim 1, wherein the electronic module further comprises a wireless transceiver configured to wirelessly communicate with a wireless mobile device; and the processor is further configured to transmit the heart rate of the user to the wireless mobile device.

14. The fitness-training device of claim 13, wherein the processor is further configured to send the count of repetitive movements performed by the user to the wireless mobile device.

15. The fitness-training device of claim 1, wherein the hand-graspable housing further comprises a weight configured to increase the mass of the hand-graspable housing.

16. A fitness-training device comprising:

a hand-graspable housing configured to be hand graspable by a user; and an electronic module disposed within the hand-graspable housing, the electronic fitness-training module including a heart-beat sensor configured to produce a first set of output signals corresponding to heart beats of the user, a movement sensor configured to produce a second set of output signals corresponding to movement of the user during a fitness activity, a memory configured to store target heart rate range data, a user input element configured to enable the user to input a target heart rate range within the memory, a visual display element configured to display visual information, an illuminated alert element configured to provide an illuminated visual alert discernable by the user, an auditory alert element configured to provide an auditory alert discernable by the user, a haptic alert element configured to provide a haptic alert discernable by the user, a processor communicably coupled to the heart-beat sensor, the movement sensor, the memory, the user input element, the visual display element, the illuminated alert element, the auditory alert element, and the haptic alert element, the processor configured to determine a heart rate of the user using the first set of output signals, display the heart rate of the user on the visual display element, display the target heart range input on the visual display element, compare the heart rate of the user to the target heart range input within the memory, generate a user alert on at least one of the illuminated alert element, the auditory alert element, and the haptic alert element when the heart rate of the user falls within the target heart range input within the memory, identify repetitive signal patterns within the second set of output signals to generate a count of repetitive movements performed by the user during the fitness activity, and display the count of repetitive movements performed by the user on the visual display element;

a power supply configured to power the electronic module;

a flexible cord wherein the hand-graspable housing is configured as a hand grip of a jump rope;

wherein the heart-beat sensor comprises a photoplethysmogram-type heart rate sensor; wherein the heart-beat sensor is positioned within the hand grip to allow generation of the first set of output signals when the user grasps the hand grip;

wherein the hand grip further comprises a swivel adapted to rotationally couple the flexible cord to the hand grip;

wherein the movement sensor is configured to sense rotational motion of the flexible cord during the fitness activity;

wherein the movement sensor comprises a light source, a photo detector positioned to receive light emitted by the light source, and a rotational shaft joined with the swivel, the rotational shaft having an opaque panel configured to interrupt the light passing between the light source and the photo detector at least once during a complete rotation of the swivel;

wherein the electronic module further comprises a timer to time a duration of the fitness activity;

wherein the user input element is further configured to receive user inputs defining the duration of the fitness activity;

wherein the processor is further configured to generate a user alert on at least one of the illuminated alert element, the auditory alert element, and the haptic alert element when the duration of the fitness activity is completed;

wherein the visual display element comprises an organic light-emitting diode display;

wherein the illuminated alert element comprises at least one illuminated light-emitting diode;

wherein the haptic alert element comprises a vibrating motor;

wherein the user input element comprises a set of momentary-contact switches;

wherein the power supply comprises at least one rechargeable battery; and the hand-graspable housing further comprises a charge port configured to couple with an electrical power source useable to charge the rechargeable battery;

wherein the memory further includes a pre-defined dataset comprising target heartrate range data; and the user input element is further configured to receive user inputs defining a target heart rate range selected from the pre-defined dataset; and wherein the electronic module further comprises a wireless transceiver configured to wirelessly communicate with a wireless mobile device; and the processor is further configured to transmit the heart rate of the user to the wireless mobile device.

17. The fitness-training device of claim 16, further comprising set of instructions; and wherein the fitness-training device is arranged as a kit.

18. A method of enhancing fitness-training, the method comprising the steps of:

providing a hand-graspable housing configured to be hand graspable by a user; and providing an electronic fitness-training module disposed within the hand-graspable housing, the electronic fitness-training module including a heart-beat sensor configured to produce a first set of output signals corresponding to heart beats of the user, a movement sensor configured to produce a second set of output signals corresponding to movement of the user during a fitness activity, a memory configured to store target heart rate range data, a user input element configured to enable the user to input a target heart rate range within the memory, a visual display element configured to display visual information, an illuminated alert element configured to provide an illuminated visual alert discernable by the user, an auditory alert element configured to provide an auditory alert discernable by the user, a haptic alert element configured to provide a haptic alert discernable by the user, a processor communicably coupled to the heart-beat sensor, the movement sensor, the memory, the user input element, the visual display element, the illuminated alert element, the auditory alert element, and the haptic alert element; and configuring the processor to determine a heart rate of the user using the first set of output signals, compare the heart rate of the user to the target heart range input within the memory, generate a user alert on at least one of the illuminated alert element, the auditory alert element, and the haptic alert element when the heart rate of the user falls within the target heart range input within the memory, identify repetitive signal patterns within the second set of output signals to generate a count of repetitive movements performed by the user during the fitness activity, and display the count of repetitive movements performed by the user on the visual display element; and providing a flexible cord wherein the hand-graspable housing is configured as a hand grip of a jump rope.

19. The method of claim 18, further comprising the steps of providing a wireless transceiver within the electronic module, the wireless transceiver configured to wirelessly communicate with a wireless mobile device; and configuring the processor to transmit the heart rate of the user to the wireless mobile device using the wireless transceiver.

* * * * *